US008327660B2

(12) United States Patent
Stitou et al.

(10) Patent No.: US 8,327,660 B2
(45) Date of Patent: Dec. 11, 2012

(54) PRODUCTION OF VERY LOW-TEMPERATURE REFRIGERATION IN A THERMOCHEMICAL DEVICE

(75) Inventors: Driss Stitou, St Nazaire (FR); Nathalie Mazet, Perpignan (FR); Bernard Spinner, Perpignan (FR); Caroline Spinner Brossard, legal representative, Brassac (FR); Anne Christel Spinner Kohler, legal representative, Narbonne (FR); Bruno Spinner, legal representative, Fabrèges (FR); Martin Spinner, legal representative, Perpignan (FR); Camille Spinner, legal representative, Perpignan (FR)

(73) Assignee: Centre National de la Recherche Scientifique, Paris (FR)

( * ) Notice: Subject to any disclaimer, the term of this patent is extended or adjusted under 35 U.S.C. 154(b) by 1016 days.

(21) Appl. No.: 11/666,926

(22) PCT Filed: Nov. 4, 2005

(86) PCT No.: PCT/FR2005/002748

§ 371 (c)(1),
(2), (4) Date: Oct. 9, 2007

(87) PCT Pub. No.: WO2006/048558

PCT Pub. Date: May 11, 2006

(65) Prior Publication Data

US 2009/0094996 A1 Apr. 16, 2009

(30) Foreign Application Priority Data

Nov. 4, 2004 (FR) ..... 04 11766

(51) Int. Cl.
*F25B 15/00* (2006.01)

(52) U.S. Cl. ..... 62/476; 62/101; 62/332; 62/333; 62/335

(58) Field of Classification Search ..... 62/101, 62/476, 332, 333, 335
See application file for complete search history.

(56) References Cited

U.S. PATENT DOCUMENTS 4,623,018 A 11/1986 Takeshita et al.

(Continued)

FOREIGN PATENT DOCUMENTS

WO WO 97/40328 A1 10/1997
WO WO 2005108880 A1 * 11/2005

OTHER PUBLICATIONS

Imoto, T. et al., "Development of an F-Class Refrigeration System Using Hydrogen-Absorbing Alloys", Int. J. Hydrogen Energy, vol. 21, No. 6, pp. 451-455, 1996, Paris, France, XP000587901.

(Continued)

*Primary Examiner* — Cheryl J Tyler
*Assistant Examiner* — Jonathan Koagel
(74) *Attorney, Agent, or Firm* — Merchant & Gould

(57) ABSTRACT

The invention relates to a thermochemical device and to a method for producing refrigeration at very low temperature. The device produces refrigeration at a temperature $T_f < -20°$ C., from an available heat source at a temperature $T_h$ of 60-80° C. and a heat sink at the ambient temperature $T_o$ of 10° C.-25° C. It comprises two coupled dipoles, operating in phase opposition. The thermochemical phenomena in one of the dipoles are such that this dipole may produce refrigeration at $T_f$ with a heat sink at the ambient temperature $T_o$. The thermochemical phenomena in the other dipole are such that this dipole may be regenerated from the heat source $T_h$ and a heat sink at the temperature $T_o$.

9 Claims, 5 Drawing Sheets

U.S. PATENT DOCUMENTS

| | | | |
|---|---|---|---|
| 4,944,159 | A | 7/1990 | Crozat |
| 5,083,607 | A | 1/1992 | Lebrun et al. |
| 5,174,367 | A | 12/1992 | Nasako et al. |
| 5,351,493 | A | 10/1994 | Hiro et al. |
| 5,857,346 | A | 1/1999 | Goetz |

OTHER PUBLICATIONS

International Search Report dated Mar. 17, 2006 (Three (3) pages).

* cited by examiner

PRODUCTION OF VERY LOW-TEMPERATURE REFRIGERATION IN A THERMOCHEMICAL DEVICE

The present invention relates to a thermochemical device for producing refrigeration at very low temperature.

BACKGROUND OF THE INVENTION

A system composed of a thermochemical dipole using two reversible thermochemical phenomena is a known means for producing refrigeration. The thermochemical dipole comprises an LT reactor, an HT reactor and means for exchanging a gas between LT and HT. The two reactors are the site of reversible thermochemical phenomena chosen so that, at a given pressure in the dipole, the equilibrium temperature in LT is below the equilibrium temperature in HT.

The reversible phenomenon in the HT reactor involves a sorbent S and a gas G and may be:

- a reversible adsorption of G by a microporous solid S;
- a reversible chemical reaction between a reactive solid S and G; or
- an absorption of G by a saline or binary solution S according to the scheme:

$$\text{“sorbent } S\text{”} + \text{“}G\text{”} \leftrightarrows \text{“sorbent } S+G\text{”}.$$

The reversible phenomenon in the LT reactor involves the same gas G. It may be a liquid/gas phase change of the gas G or a reversible adsorption of G by a microporous solid $S^1$, or a reversible chemical reaction between a reactive solid $S^1$ and G, or an absorption of G by a solution S1, the sorbent S1 being different from S. The refrigeration production step of the device corresponds to the synthesis step in HT:

$$\text{“sorbent } S\text{”} + \text{“}G\text{”} \leftrightarrows \text{“sorbent } S+G\text{”}.$$

The regeneration step corresponds to the decomposition step in HT:

$$\text{“sorbent } S+G\text{”} \rightarrow \text{“sorbent } S\text{”} + \text{“}G\text{”}.$$

The production of refrigeration at a temperature $T_f$ in a dipole (LT, HT) from a heat source at the temperature $T_c$ and from a heat sink at the temperature $T_o$, implies that the thermochemical phenomenon in LT and the thermochemical phenomenon in HT are such that:

- during the step of producing refrigeration by the dipole, the exothermic consumption of gas in HT takes place at a temperature close to and above $T_o$, which creates a pressure in the dipole such that the equilibrium temperature in the reactor LT is close to and below $T_f$; and
- during the step of regenerating the dipole, the endothermic release of gas in HT is carried out at the temperature $T_o$, which creates a pressure in the dipole such that the temperature at which the exothermic consumption of gas in LT is carried out is close to and above $T_o$.

The thermochemical phenomena currently used enable refrigeration to be produced at a negative temperature in LT, but they do not fulfill the above criteria with the objective of producing refrigeration at very low temperature ($T_f$ typically from −20° C. to −40° C.) for long-lasting foodstuff preserving and freezing applications from a heat source, with the thermal potential of which is around 60 to 80° C., the heat sink generally composed of the ambient medium being at a temperature $T_o$ of around 10° C. to 25° C. These phenomena either require, during the regeneration, a temperature $T_c$ well above 70° C. to operate with a heat sink at the ambient temperature $T_o$, or they require a heat sink at a temperature below $T_o$ if a heat source at $T_c$=60-80° C. is used.

For example, to produce refrigeration at −30° C. using a heat source at 70° C., when LT is the site of an L/G phase change of ammonia $NH_3$, and HT is the site of a chemical sorption of $NH_3$ by a reactive solid S: if S is $BaCl_2$, a heat sink at 0° C. would be needed for the reactor LT during the refrigeration production step, whereas if S is $CaCl_2$, a heat sink at −5° C., that is to say at a temperature well below $T_o$, would be needed during the regeneration step.

Solar energy or geothermal energy are advantageous heat sources, but they supply heat at a low temperature level which is not, in general, above 60-70° C. when a low-cost collection technology is used, such as for example flat collectors conventionally used for producing domestic hot water. The use of these types of energy consequently does not enable the intended aim to be achieved.

SUMMARY OF THE INVENTION

The inventors have now found that it was possible to produce refrigeration at a temperature $T_f$ below −20° C. from a heat source at a temperature $T_h$ between 60 and 80° C., and from a heat sink at the ambient temperature $T_o$ varying from 10° C. to 25° C., by combining two dipoles D1 and D2 so that:

- the dipole D2 operates with thermochemical phenomena capable of producing refrigeration at a temperature $T_f$ below −20° C. with a heat sink at $T_o$, but which would require for its regeneration a heat source at a temperature above the temperature $T_h$ with a heat sink at $T_o$; and
- the dipole D1 operates with thermochemical phenomena that can be regenerated from an available heat source at the temperature $T_h$ and from a heat sink at the temperature $T_o$.

The object of the present invention is consequently to provide a method and a device for producing refrigeration at a temperature $T_f$ below −20° C., from a heat source at a temperature $T_h$ of around 60-80° C. and from a heat sink at the ambient temperature $T_o$ of around 10° C. to 25° C.

BRIEF DESCRIPTION OF THE DRAWINGS

FIGS. 1*a* and 1*b* represent the Clausius-Clapeyron plots respectively for the refrigeration production step (FIG. 1*a*), and for the regeneration step (FIG. 1*b*).

FIGS. 2*a* and 2*b* represent the Clausius-Clapeyron plot respectively for the refrigeration production step (FIG. 2*a*), and for the regeneration step (FIG. 2*b*).

DETAILED DESCRIPTION OF THE PREFERRED EMBODIMENTS

Figure 1A:
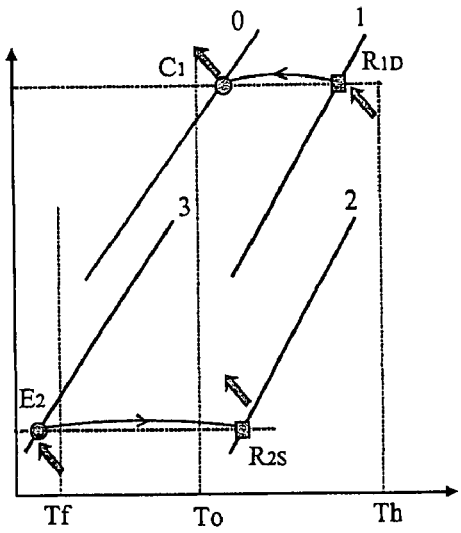
FIGS. 1*a* and 1*b* illustrate the method for producing refrigeration according to the first embodiment.

The device for producing refrigeration according to the present invention comprises a refrigeration-producing dipole D2 and an auxiliary dipole D1, and it is characterized in that:

- the thermochemical phenomena in the dipole D2 are such that this dipole may produce refrigeration at $T_f$ with a heat sink at the ambient temperature $T_o$;
- the thermochemical phenomena in the dipole D1 are such that this dipole may be regenerated from the heat source $T_h$ and a heat sink at the temperature $T_o$;
- D1 comprises an evaporator/condenser EC1 and a reactor R1 connected via a line enabling the controlled flow of gas, and D2 comprises an evaporator/condenser EC2 and a reactor R2 connected by a line enabling the controlled flow of gas;
- EC1 contains a gas G1 and R1 contains a sorbent S1 able to form a reversible physico-chemical process with G1, and EC2 contains a gas G2 and R2 contains a sorbent S2 able to form a reversible physico-chemical process with G2;
- the dipoles D1 and D2 are equipped with means that enable them to be coupled together by thermal coupling when G1 and G2 are different and by mass coupling when G1 and G2 are identical; and
- the gases and the sorbents used are chosen so that, when the dipoles are coupled, the equilibrium temperatures of the thermochemical phenomena in the reactors and the evaporators/condensers are such that $T(EC1) \leqq T(EC2) < T(R1) < T(R2)$.

In the remainder of the text, the expressions "the elements" of a dipole will be used to denote both the reactor and the evaporator/condenser of the dipole.

As an example of thermochemical phenomena used in the present invention, mention may be made of the L/G phase change of ammonia ($NH_3$), of methylamine ($NH_2CH_3$) or of $H_2O$ in the evaporators/condensers. For the reactors, mention may be made of:

- a reversible chemical sorption of $NH_3$ by $SrCl_2$ or by $BaCl_2$, or of $NH_2CH_3$ by $CaCl_2$;
- an adsorption of water by zeolite or a silica gel;
- the adsorption of methanol (MeOH) or of ammonia in active carbon; and
- the absorption of $NH_3$ in a liquid ammonia solution ($NH_3.H_2O$).

The method for producing refrigeration at the temperature $T_f$ from a heat source at the temperature $T_h$ and from a heat sink at the ambient temperature $T_o$ consists in operating the device according to the invention from an initial state in which the dipole D2 is in the regenerated state, and the dipole D1 is to be regenerated, the two elements of a given dipole being isolated from one another, said method comprising a series of successive cycles made up of a refrigeration production step and a regeneration step;

- at the beginning of the first step, which is the step of producing refrigeration at $T_f$, the two elements of each of the dipoles are connected, which causes the spontaneous endothermic evaporation phase in EC2 (producer of refrigeration at $T_f$) which produces G2 in gas form, and the transfer of the gas released to R2 for its exothermic adsorption by S2 in R2, and at the same time heat at the temperature $T_h$ is supplied to the reactor R1, which causes the desorption of the gas G1 by S1 in R1 and the condensation phase of G1 in EC1;
- during a second step, which is the step of regenerating the device, heat at the temperature $T_h$ is supplied to the reactor R2 to carry out desorption of G2 by the sorbent S2 in R2, and either heat, when G1 and G2 are different, or gas if G1 and G2 are identical, are transferred from D2 to D1 to carry out gas sorption by S1 in R1.

In this method, the dipoles therefore operate in phase opposition: one of the dipoles is in a phase of gas absorption in the sorbent, whereas the other is in a phase of gas desorption by the sorbent.

The various steps may be carried out continuously or on demand. At the beginning of one step, the elements of one and the same dipole must be connected, so that the thermochemical phenomena can occur. In order to operate the device continuously, it is sufficient to supply, at the end of one step, the appropriate amount of heat to the appropriate reactor to start the following step. If the device is intended to be operated in batch mode, it is sufficient to isolate the elements of each dipole by insulation means, at the end of a refrigeration production step or a regeneration step.

The method may be implemented permanently if the heat at the temperature $T_h$ is available permanently, for example if it is geothermal energy. The operation will be in batch mode if the heat source is not permanent, for example if it is solar energy whose availability varies throughout a day.

In a first embodiment, the coupling of the dipoles is carried out thermally between the evaporator/condenser EC1 of the dipole D1 and the evaporator/condenser EC2 of the dipole D2, and the thermochemical phenomena are chosen such that, in this coupling phase, $T(EC1) < T(EC2) < T(R1) < T(R2)$. In this case, G1 and G2 are different.

The thermal coupling between EC1 and EC2 may be carried out, for example, by a coolant loop, by a heat pipe or by direct contact.

The method of this first embodiment is characterized in that, during the second step, the evaporators/condensers EC1 and EC2 are thermally coupled, and at the same time heat at the temperature $T_h$ is supplied to the reactor R2 to cause the endothermic desorption of G2 in R2 and the exothermic condensation of G2 in EC2, the heat generated in EC2 being transferred to the reactor EC1, which causes an endothermic evaporation of G1 in EC1 and a concomitant exothermic absorption of G1 by S1 in R1.

In this embodiment, the device produces refrigeration at the temperature $T_f$ during the refrigeration production step of the dipole D2 concomitant to the regeneration step of the auxiliary dipole D1.

During the regeneration step of the dipole D2, refrigeration may be produced at the temperature $T_i$ below $T_o$ in EC1 by the dipole D1, if the heat required during this step for the evaporation phase in EC1 is greater than the heat supplied by the condensation phase in EC2.

Figure 1B:
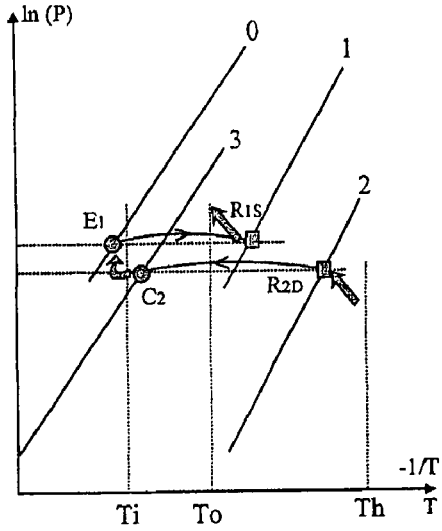

The method for producing refrigeration according to the first embodiment is illustrated in the FIGS. 1*a* and 1*b*, which represent the Clausius-Clapeyron plot respectively for the refrigeration production step (FIG. 1*a*), and for the regeneration step (FIG. 1*b*). The straight lines 0, 1, 2 and 3 represent the equilibrium curve respectively for the L/G phase change of the gas G1, the reversible phenomenon G1+S1⇆(G1, S1), the reversible phenomenon G2+S2⇆(G2, S2) and the L/G phase change of the gas G2.

During the refrigeration production step, the evaporation of G2 in EC2 (point E2 of the straight line 3) extracting heat from the ambient medium to be cooled at $T_f$ therefore produces refrigeration at this temperature. Gaseous G2 thus produced is transferred into R2 to be absorbed by S2 releasing heat at a temperature above the ambient temperature $T_o$ (point $R_{2S}$ on the straight line 2). At the same time, a supply of heat at the temperature $T_h$ to R1 (point $R_{1D}$ on the curve 1) causes the release of G1 which is transferred into EC1 for the condensation of G1 (point $C_1$ on the curve 0), releasing heat into the environment at $T_o$.

During the regeneration step of the dipole D2, which corresponds to the regeneration step of the device, heat at the temperature $T_h$ is supplied to R2 (point $R_{D2}$ on the straight line 2) which releases gaseous G2 that will be condensed in EC2 (point $C_2$ on the straight line 3) by releasing heat at the temperature $T_i$, said heat being transferred toward EC1 in order to trigger therein the release of gas G1 (point $E_1$ on the curve 0), said gas G1 flowing into R1 for the synthesis step (point $R_{1S}$ on the curve 1). If the heat supplied by EC2 to EC1 is insufficient to release all the gas in EC1, the heat is extracted from the environment, which will produce refrigeration at the temperature $T_i$ below the ambient temperature.

In a preferred form of the first embodiment, each of the elements EC is composed of an assembly comprising an evaporator E and a condenser C connected by a line enabling the flow of gas or liquid. Furthermore, in order to limit the heat losses and to improve the efficiency of the regeneration of the dipole D1, the elements involved in the thermal coupling, that is to say E1 and C2, are thermally isolated from the ambient medium.

In a second embodiment, the two dipoles operate with the same gas G. In this embodiment, the dipoles D1 and D2 of the device according to the invention are coupled, during the regeneration phase of the dipole D1, by a mass coupling which allows the flow of gas between the reactor R1 of the dipole D1 and the reactor R2 of the dipole D2 on the one hand, and between the evaporators/condensers EC1 and EC2 on the other hand. Moreover, the thermochemical phenomena are chosen so that T(EC1)=T(EC2)<T(R1)<T(R2).

The method for producing refrigeration according to this second embodiment is characterized in that, at the beginning of the second step, the connection between EC2 and R2 is stopped, and R1 and R2 are connected, and at the same time heat at the temperature $T_h$ is supplied to the reactor R2, which causes the endothermic desorption of G by S2 in R2, and by cooling the reactor R1, which causes absorption of the gas G in R1. Cooling may be carried out by using coolant circuits. Cooling may also be controlled by external conditions, for example by natural nighttime cooling, in the absence of the sun.

During the method, EC1 and EC2 are connected to make G flow in liquid form from EC1 toward EC2. This operation may be carried out during an additional step. It may, in addition, be carried out during the first or the second step, if the device comprises an expansion valve on the line connecting EC1 and EC2.

Figure 2A:
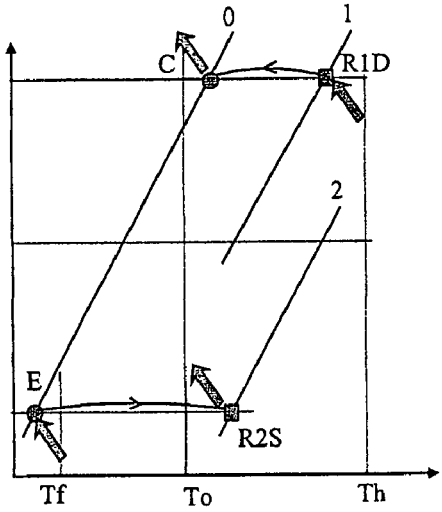
FIGS. 2*a* and 2*b* illustrate the method for producing refrigeration according to the second embodiment.
Figure 2B:
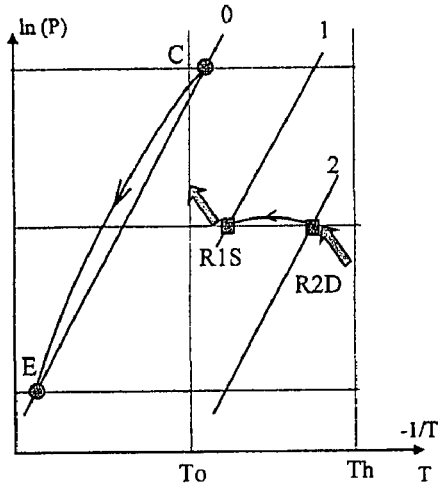

The method for producing refrigeration of this second embodiment is illustrated in the FIGS. 2*a* and 2*b*, which represent the Clausius-Clapeyron plotrespectively for the refrigeration production step (FIG. 2*a*), and for the regeneration step (FIG. 2*b*). The straight lines 0, 1 and 2 represent the equilibrium curve respectively for the L/G phase change of the gas G, the reversible phenomenon G+S1⇆(G, S1), and the reversible phenomenon G+S2⇆(G, S2).

During the refrigeration production step, the evaporation of G in EC2 (point E of the straight line 0) extracts heat at $T_f$ from the ambient medium and produces refrigeration at this temperature. Gaseous G thus released is transferred into R2 for the synthesis step with S2 releasing heat at a temperature above the ambient temperature $T_o$ (point $R_{2S}$ on the straight line 2). At the same time, a supply of heat at the temperature $T_h$ to R1 (point $R_{1D}$ on the curve 1) causes the release of G which is transferred into EC1 for the condensation of G (point C on the curve 0), releasing heat into the environment at $T_o$.

During the regeneration step, heat at the temperature $T_h$ is supplied to R2 (point $R_{2D}$ on the straight line 2) which releases gaseous G that is transferred into R1 for the synthesis with S1 (point $R_{1S}$ on the line 0).

The present invention is illustrated by the following examples, to which it is not however limited.

EXAMPLE 1

This example illustrates a device for producing refrigeration, in which the dipoles interact by a thermal coupling. Each of the elements EC is composed of a condenser and an evaporator connected by a line enabling the flow of gas or liquid, and denoted by C1, C2, E1 and E2. A schematic representation of the device is given in FIG. 3.

Figure 3:
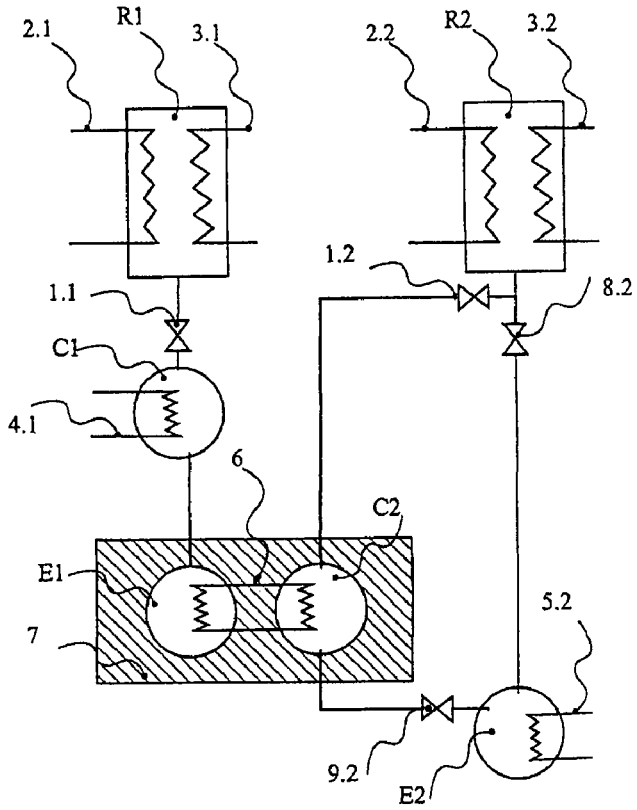
FIG. 3 provides a schematic representation of the device for producing refrigeration in which the dipoles interact by a thermal coupling of Example 1.

In accordance with FIG. 3, the dipole D1 comprises a reactor R1, a condenser C1 and an evaporator E1. R1 and C1 are connected by a line equipped with a valve 1.1, C1 and E1 are connected by a single line. R1 is equipped with heating means 2.1 and means 3.1 for extracting heat. C1 is equipped with means 4.1 for extracting the heat of condensation. The dipole D2 comprises a reactor R2, a condenser C2 and an evaporator E2. R2 and C2 are connected by a line equipped with a valve 1.2, R2 and E2 are connected by a line equipped with a valve 8.2, and C2 and E2 are connected by a line equipped with an expansion valve 9.2. R2 is equipped with heating means 2.2 and means 3.2 for removing heat. E2 is equipped with means 5.2 for extracting heat from the medium to be cooled. E1 and C2 are equipped with means 6 enabling heat to be exchanged between them and a device 7 which thermally insulates them from the environment.

R1 is the site of a reversible chemical sorption of methylamine (gas G1) on $CaCl_2.2NH_2CH_3$ (the reactive solid S1), C1 and E1 being the site of a condensation/evaporation phenomenon of methylamine (the gas G1). R2 is the site of a reversible chemical sorption of $NH_3$ (the gas G2) on $CaCl_2.4NH_3$ (the solid S2), C2 and E2 being the site of a condensation/evaporation phenomenon of the gas $NH_3$.

The thermochemical phenomena are as follows:

for the dipole 1:

$$NH_2CH_{3(gas)} \leftrightarrows NH_2CH_{3(liquid)}$$

$$(CaCl_2.2NH_2CH_3)+4NH_2CH_3 \leftrightarrows (CaCl_2 6NH_2CH_3)$$

for the dipole 2:

$$NH_{3(gas)} \leftrightarrows NH_{3(liquid)}$$

$$(CaCl_2.4NH_3)+4NH_3 \leftrightarrows (CaCl_2.8NH_3)$$

Figure 9:
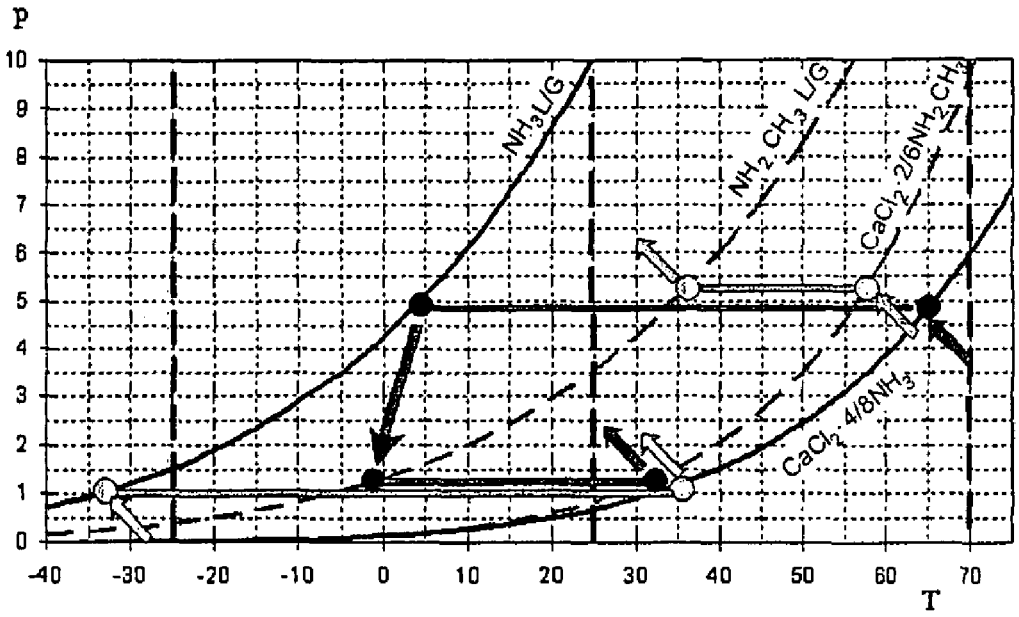
FIG. 9 provides the equilibrium curves of the thermochemical phenomena for the operation of the device of Example 1.

The operation of the device comprising these reactants is represented in FIG. 9, which gives the equilibrium curves of the thermochemical phenomena in question.

Figure 4:
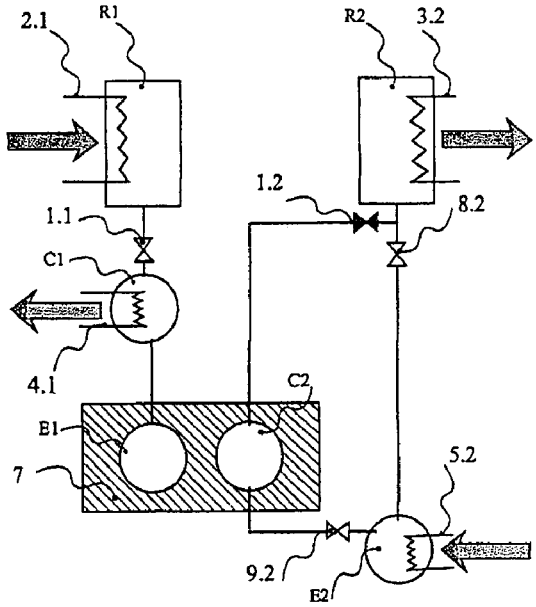
FIG. 4 illustrates the parts of the device for producing refrigeration of Example 1 that are active during the refrigeration production step.

The parts of the device that are active during the refrigeration production step are represented in FIG. 4. The valves 1.1 and 1.2 are opened and the heat transfer means 6 are deactivated. Opening the valves 8.2 and 9.2 causes the spontaneous production of the gas G2 in E2, the transfer of G2 toward R2 and through the valve 8.2, which causes on the one hand the production of refrigeration around E2 by the means for extracting heat 5.2, and the synthesis in R2, with removal of the heat formed toward the atmosphere around R2 using the means 3.2. At the same time, the heating means 2.1 supply heat that is at the temperature $T_h$ to R1, which causes the production of G2 in R2, G2 flowing into C1 connected thermally to the environment by the means 4.1. G2 condenses in C2 and flows into E1.

Figure 5:
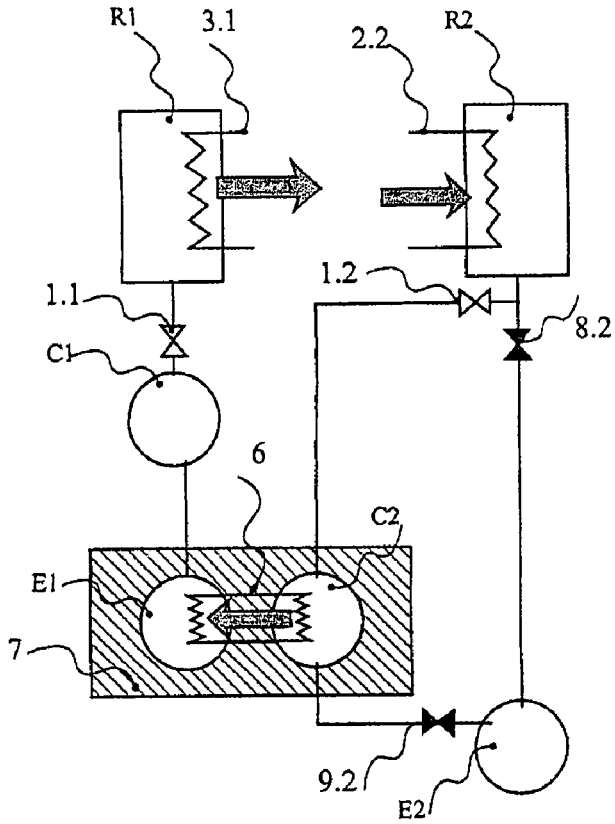
FIG. 5 illustrates the parts of the device for producing refrigeration of Example 1 that are active during the regeneration step.

The parts of the devices that are active during the regeneration step of the device are represented in FIG. 5. The valves 1.1 and 1.2 remain open, R2 is supplied with heat at the temperature $T_h$ by the means 2.2, which releases the gas G2 that flows into the condenser C2 in which it is condensed before flowing simultaneously or subsequently into the evaporator E2, depending on the state of the valve 9.2. The heat released by the condensation in C2 is transferred toward E1 by the means 6. This supply of heat in E1 causes an evaporation of G1 which is transferred via C1 and the valve 1.1 into R1 where it is absorbed by S1, the heat released by this absorption being transferred toward the environment at the temperature $T_o$ by the means 3.1. At the end of this step, the device is again ready to produce refrigeration. If the production must be immediate, the first step is restarted. If the production must be deferred, the device is kept in the regenerated state by closing the valves 1.1, 1.2 and 8.2.

Such a device enables refrigeration to be produced at a temperature $T_i$ halfway between $T_o$ and $T_f$ during the regeneration step of the device. For example, referring to FIG. 9, if the heat supplied by EC2 by the condensation of $NH_3$ to EC1 for the evaporation of $NH_2CH_3$ is insufficient to release all the $NH_2CH_3$, heat is extracted from the environment, which will produce refrigeration at the temperature $T_i$ around 0° C.

EXAMPLE 2

This example illustrates a device for producing refrigeration, in which the dipoles interact by mass coupling. EC1 and EC2 are respectively a condenser C1 and an evaporator E2. A schematic representation of the device is given in FIG. 6.

Figure 6:
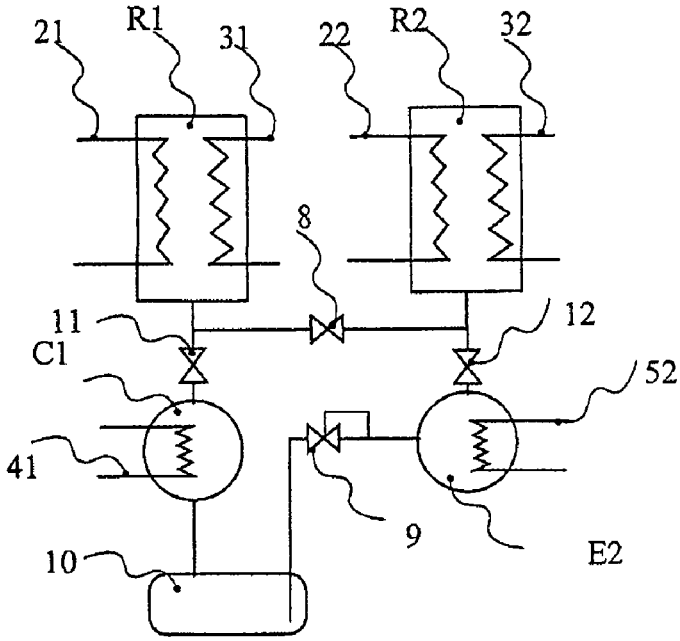
FIG. 6 provides a schematic representation of the device for producing refrigeration in which the dipoles interact by mass coupling of Example 2.

In accordance with FIG. 6, the dipole D1 comprises the reactor R1 and the condenser C1 connected by a line equipped with a valve 11. R1 comprises means 21 for introducing heat and means 31 for removing heat. C1 comprises means 41 for removing heat. The dipole D2 comprises the reactor R2 and the evaporator E2 connected by a line equipped with a valve 12. R2 comprises means 22 for introducing heat and means 32 for removing heat. E2 comprises means 52 for supplying heat.

R1 and R2 are connected by a line which is placed before the valves 11 and 12, and which is equipped with a valve 8. C1 is connected by a line to a reservoir which is itself connected to E2 by a line equipped with an expansion valve 9 which may be, for example, controlled and activated by a drop in the pressure or liquid level in E2.

Figure 7:
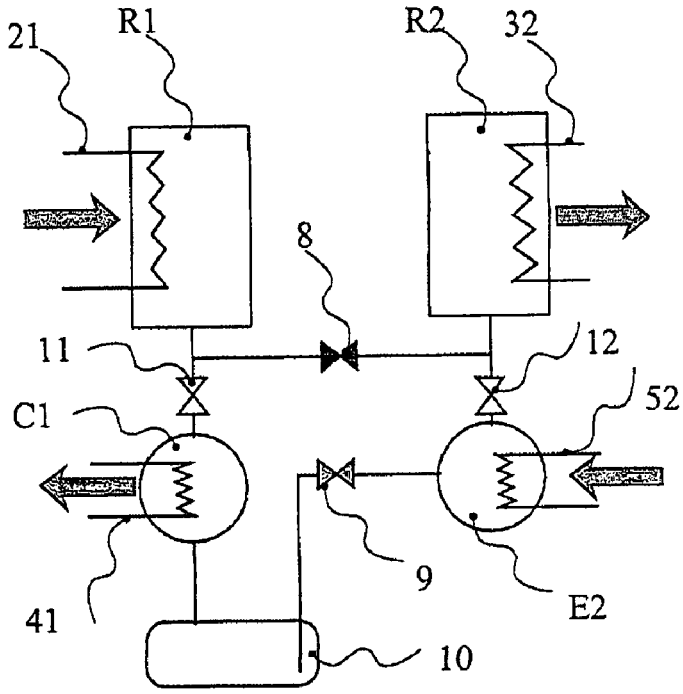
FIG. 7 illustrates the parts of the device for producing refrigeration of Example 2 that are active during the refrigeration production step.

The active parts of the device during the refrigeration production step are represented in FIG. 7. The valve 8 is closed, the expansion valve 9 is activated depending on the liquid level or the pressure in E2, and the valves 11 and 12 are opened. Opening the valve 12 causes the exothermic evaporation of gas in E2 with production of refrigeration, and the exothermic synthesis in R2, the heat being extracted by 32. At the same time, R1 is supplied with heat at the temperature $T_f$ via 21, which causes the release of gas in R1, the transfer of this gas toward C in which it condenses, the heat of condensation being transferred toward the environment by 41. The condensed liquid in C is transferred into the reservoir 10.

Figure 8:
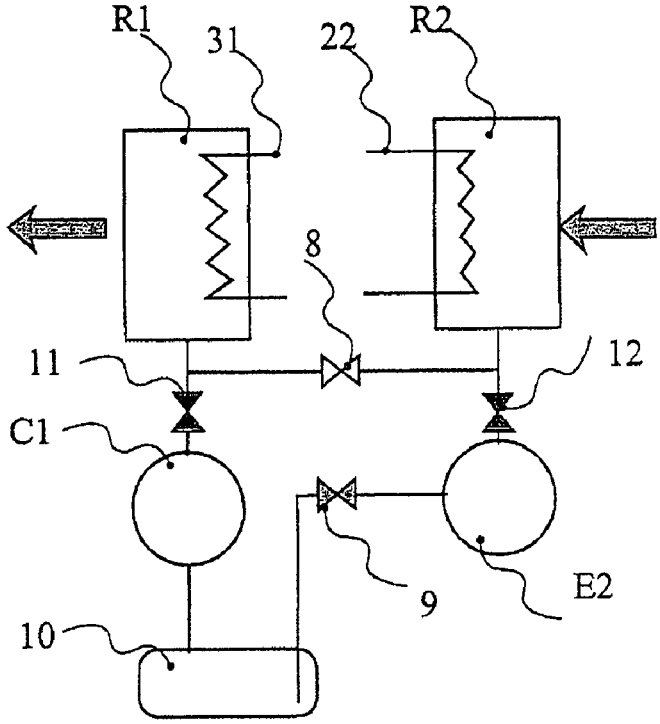
FIG. 8 illustrates the parts of the device for producing refrigeration of Example 2 that are active during the regeneration step.

The active parts of the device during the regeneration step are represented in FIG. 8. At the beginning of this step, the valves 11 and 12 are closed, the valve 8 is opened and the expansion valve 9 is closed, considering the fact that the pressure or the liquid level in E2 have not decreased. A supply of heat at the temperature $T_f$ to R2 via 22 causes a release of gas in R2, the transfer of this gas toward R1 via the valve 8, and the exothermic synthesis in R1, the heat released being removed via 31.

Such a device may be implemented using ammonia as gas G, $CaCl_2.4NH_3$ as solid S2 in R2 and $BaCl_2$ as solid S1 in R1.

The thermochemical phenomena are as follows:

$$NH_{3(gas)} \leftrightarrows NH_{3(liquid)}$$

$$(CaCl_2.4NH_3)+4NH_3 \leftrightarrows (CaCl_2.8NH_3)$$

$$(BaCl_2)+8NH_3 \leftrightarrows (BaCl_2 8NH_3)$$

Figure 10:
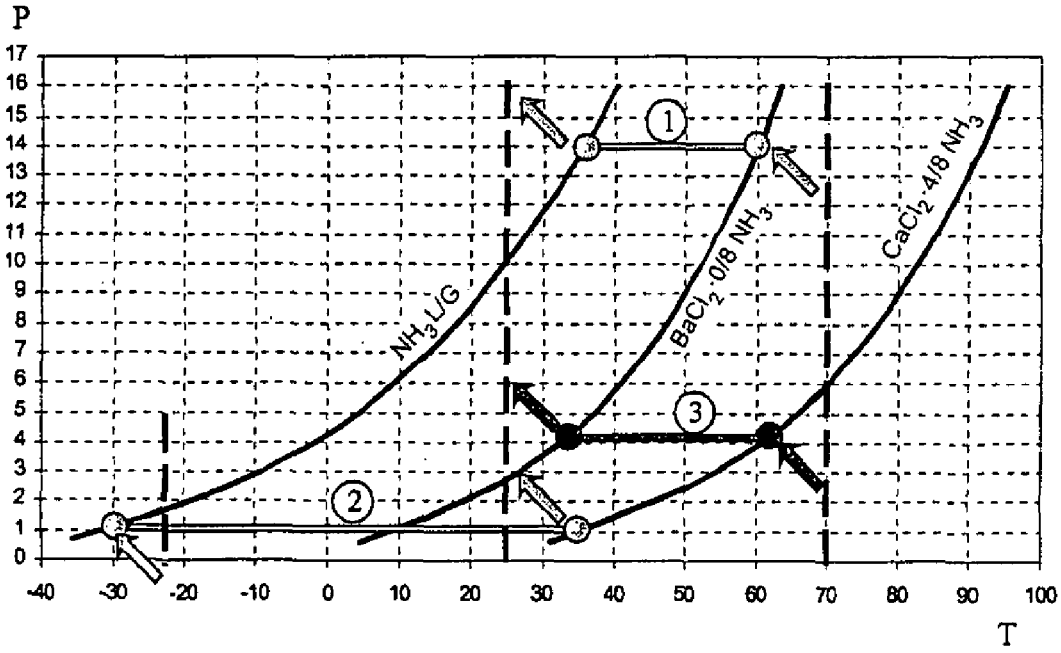
FIG. 10 provides the equilibrium curves of the thermochemical phenomena for the operation of the device of Example 2.

The operation of the device comprising these reactants is represented in FIG. 10, which gives the equilibrium curves of the thermochemical phenomena in question. Similar curves would be obtained with a similar device, in which $CaCl_2.4NH_3$ would be replaced with $SrCl_2.NH_3$.

The refrigeration production step is embodied by the positions 1 and 2 of the dipoles D1 and D2. D1 is in regeneration phase due to the introduction of available heat at the temperature $T_h$ of around 70° C., to cause the decomposition of ($BaCl_2.8NH_3$) in R1 with release of $NH_3$ which will be condensed in C1 releasing heat into the heat sink constituted by the surroundings at $T_o$=25° C. Concomitantly, D2 is in refrigeration production phase, extracting heat from the medium to be cooled to a temperature $T_f$ of around −30° C.

The regeneration step of D2 is embodied by the position 3. The supply of the available heat at the temperature $T_h$ of around 70° C. causes the decomposition of ($CaCl_2.8NH_3$) releasing $NH_3$, which is transferred into R1 to cause therein the synthesis of $BaCl_2.8NH_3$. At this stage, the reactors R1 and R2 are in the state required for a regenerated device, and the opening of the valve 9 enables C1 and E2 to be put into the required state for complete regeneration of the device.

The invention claimed is:

1. A device for producing refrigeration comprising two dipoles, a refrigeration-producing dipole D2 and a second dipole D1, wherein:

dipole D2 produces refrigeration at $T_f$ and is regenerated from the heat source at $T_h$ with the heat sink at the ambient temperature $T_o$;

dipole D1 is regenerated from the heat source $T_h$ and the heat sink at the temperature $T_o$;

dipole D1 comprises an evaporator and condenser EC1, which is an enclosure in which an evaporation or a condensation occurs, and a reactor R1 connected via a line enabling the controlled flow of gas, and dipole D2 comprises an evaporator and condenser EC2, which is an enclosure in which an evaporation or a condensation occurs, and a reactor R2 connected by a line enabling the controlled flow of gas;

the evaporator and condenser EC1 contains a gas G1 and the reactor R1 contains a sorbent S1 which forms a reversible physico-chemical process with the gas G1, and the evaporator and condenser EC2 contains a gas G2 and the reactor R2 contains a sorbent S2 which forms a reversible physico-chemical process with the gas G2; wherein the sorbent S1 and the sorbent S2 are different;

the gases and the sorbents used provide that at a given pressure, equilibrium temperatures of thermochemical processes in the reactors R1 and R2 and the evaporators and condensers EC1 and EC2 are such that T(EC1)≦T(EC2)<T(R1)<T(R2); and the two dipoles D1 and D2 are coupled together only during the regeneration phase of the device, said coupling being performed either by a thermal transfer from EC2 of dipole D2 to EC1 of dipole D1 when the reactive gases G1 and G2 contained in the two dipoles are different, or by a mass transfer between the two reactors R1 and R2 when the reactive gases contained in the two dipoles are identical, wherein said device produces refrigeration at a temperature $T_f$ below −20° C., from a heat source at a temperature $T_h$ of around 60-80° C. and from a heat sink at the ambient temperature $T_o$ of around 10° C. to 25° C.

2. The device as claimed in claim 1, wherein thermochemical processes in the evaporators and condensers EC1 and EC2 are chosen from the L/G phase change of ammonia ($NH_3$), the phase change of methylamine ($NH_2CH_3$) and the phase change of $H_2O$.

3. The device as claimed in claim 1, wherein the thermochemical processes in the reactors R1 and R2 are chosen from the reversible chemical sorptions of $NH_3$ by $CaCl_2$, by $SrCl_2$ or by $BaCl_2$, or of $NH_2CH_3$ by $CaCl_2$, the adsorption of water by zeolite or a silica gel, the adsorption of methanol or of ammonia in active carbon, and the absorption of $NH_3$ in a liquid solution of ammonia ($NH_3.H_2O$).

4. The device as claimed in claim 1, wherein each of the evaporators and condensers EC1 and EC2 is made up of an assembly comprising an evaporator E and a condenser C connected by a line allowing the flow of gas or of liquid.

5. A method for producing refrigeration at a temperature $T_f$ below −20° C., from a heat source at a temperature $T_h$ of around 60-80° C. and from a heat sink at the ambient temperature $T_o$ of around 10° C. to 25° C., wherein the method consists in operating the device according to claim 1 from an initial state in which the dipole D2 is in the regenerated state, and the dipole D1 is to be regenerated, the two elements of a given dipole being isolated from one another, said method comprising a series of successive cycles made up of a refrigeration production step and a regeneration step;

at the beginning of the first step, which is the step of producing refrigeration at $T_f$, the two elements of each of the dipoles are connected, which causes the spontaneous endothermic evaporation phase in the evaporator and condenser EC2 (producer of refrigeration at $T_f$) which produces the gas G2 in gas form, and the transfer of the gas released to the reactor R2 for the gas exothermic adsorption by the sorbent S2 in the reactor R2, and at the same time heat at the temperature $T_h$ is supplied to the reactor R1, which causes the desorption of the gas G1 by the sorbent 51 in the reactor R1 and the condensation phase of the gas G1 in the evaporator or condenser EC1;

during a second step, which is the step of regenerating the device, heat at the temperature $T_h$ is supplied to the reactor R2 to carry out desorption of the gas G2 by the sorbent S2 in the reactor R2, and either heat, when the gases G1 and G2 are different, or gas if the gas G1 and the gas G2 are identical, are transferred from the dipole D2 to the dipole D1 to carry out gas sorption by the sorbent 51 in the reactor R1.

6. The method as claimed in claim 5, wherein the coupling of the dipoles is carried out thermally between the evaporator and condenser EC1 of the dipole D1 and the evaporator and condenser EC2 of the dipole D2, the gases G1 and G2 are different, and the thermochemical phenomena are chosen such that, in this coupling phase, T(EC1)<T(EC2)<T(R1)<T(R2).

7. The method as claimed in claim 6, wherein, during the second step, the evaporators and condensers EC1 and EC2 are thermally coupled, and at the same time heat at the temperature $T_h$ is supplied to the reactor R2 to cause the endothermic desorption of the gas G2 in the reactor R2 and the exothermic condensation of the gas G2 in the evaporator and condenser EC2, the heat generated in the evaporator and condenser EC2 being transferred to the evaporator and condenser EC1, which causes an endothermic evaporation of the gas G1 in the evaporator and condenser EC1 and a concomitant exothermic absorption of the gas G1 by the sorbent S1 in the reactor R1.

8. The method as claimed in claim 5, wherein the dipoles D1 and D2 operating with the gas G1 and G2 being the same and that are coupled, during the regeneration phase of the dipole D1, by a mass coupling which allows the flow of gas between the reactor R1 of the dipole D1 and the reactor R2 of the dipole D2 on the one hand, and between the evaporators and condensers EC1 and EC2 on the other hand, the thermochemical phenomena being chosen so that T(EC1)=T(EC2)<T(R1)<T(R2).

9. The method as claimed in claim 8, wherein, at the beginning of the second step, the connection between the evaporator and condenser EC2 and the reactor R2 is stopped, and the evaporator and condenser EC2 and the reactor R2 are connected, and at the same time heat at the temperature $T_h$ is supplied to the reactor R2, which causes the endothermic desorption of the gas G2 in the reactor R2, and by cooling the reactor R1, which causes absorption of the gas G1 in the reactor R1.

* * * * *